United States Patent [19]

Corns et al.

[11] 4,176,048

[45] Nov. 27, 1979

[54] PROCESS FOR CONVERSION OF HEAVY HYDROCARBONS

[75] Inventors: Joseph B. Corns, Munster, Ind.; Thomas D. Nevitt; Waldemar R. Hertwig, both of Naperville, Ill.

[73] Assignee: Standard Oil Company (Indiana), Chicago, Ill.

[21] Appl. No.: 956,280

[22] Filed: Oct. 31, 1978

[51] Int. Cl.[2] ..... C10G 23/02; C10G 37/06; C10G 13/02

[52] U.S. Cl. ..... 208/59; 208/89; 208/309

[58] Field of Search ..... 208/59, 58, 85, 86, 208/89, 309, 22, 95, 96

[56] References Cited

U.S. PATENT DOCUMENTS

| | | | |
|---|---|---|---|
| 2,715,603 | 8/1955 | Lanning et al. | 208/96 |
| 3,132,088 | 5/1964 | Beuther et al. | 208/67 |
| 3,730,875 | 5/1973 | Gleim et al. | 208/22 |
| 3,876,523 | 4/1975 | Rosinski et al. | 208/89 |
| 3,891,541 | 6/1975 | Oleck et al. | 208/89 X |

*Primary Examiner*—Delbert E. Gantz
*Assistant Examiner*—G. E. Schmitkons
*Attorney, Agent, or Firm*—Geofrey M. Novelli; Arthur G. Gilkes; William T. McClain

[57] ABSTRACT

Heavy hydrocarbon streams containing asphaltenes are hydrocracked in a first hydrocracking zone and asphaltenes are removed from the liquid effluent to form a deasphaltened liquid feed to a second hydrocracking zone.

8 Claims, 1 Drawing Figure

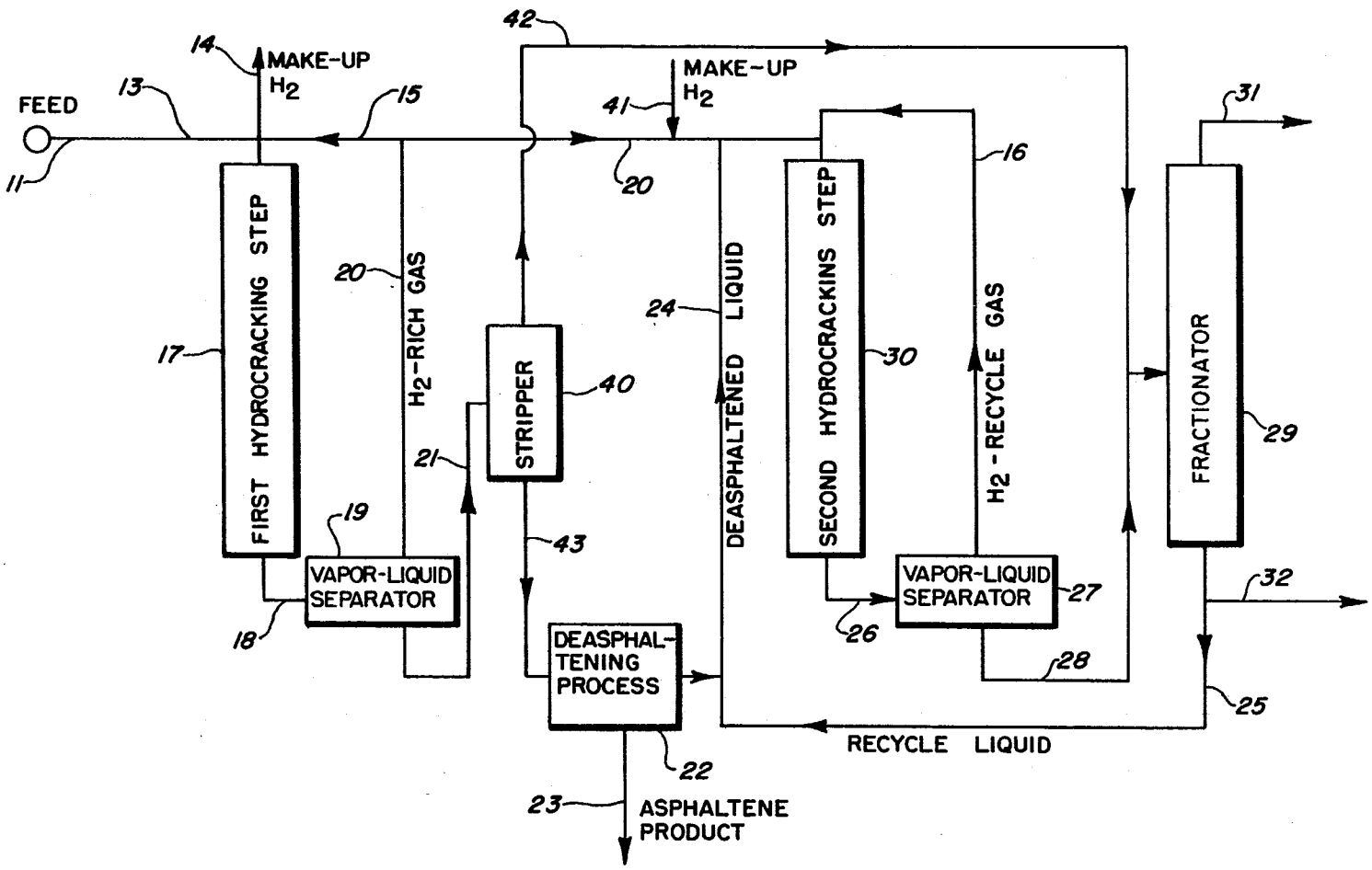
FEED
11
13
14
MAKE-UP $H_2$
15
FIRST HYDROCRACKING STEP
17
18
VAPOR-LIQUID SEPARATOR
19
$H_2$-RICH GAS
20
21
STRIPPER
40
42
MAKE-UP $H_2$
41
20
43
DEASPHALTENED LIQUID
24
DEASPHAL-TENING PROCESS
22
ASPHALTENE PRODUCT
23
SECOND HYDROCRACKINS STEP
30
26
VAPOR-LIQUID SEPARATOR
27
28
$H_2$-RECYCLE GAS
16
RECYCLE LIQUID
25
FRACTIONATOR
29
31
32

PROCESS FOR CONVERSION OF HEAVY HYDROCARBONS

BACKGROUND

This invention relates to hydrotreatment of heavy hydrocarbon streams containing asphaltenes. The invention relates more particularly to partial conversion of said asphaltenes to lower boiling, more valuable products and the removal of those asphaltenes which are not readily susceptible to such conversion.

As refiners increase the proportion of heavier, poorer quality crude oil in the feedstock to be processed, the need grows for processes to treat the fractions containing increasingly higher levels of asphaltenes and metals. Asphaltenes are polynuclear aromatic compounds with molecular weights as high as about 10,000 and generally boil above 1,000° F.

It is widely known that asphaltenes are present in petroleum crude oils and other heavy petroleum hydrocarbon streams, such as petroleum hydrocarbon residua, hydrocarbon streams derived from tar sands, and hydrocarbon streams derived from coals. Much of the metals such as nickel, vanadium, and iron commonly found in such hydrocarbon streams are bound in the asphaltene molecules. In various refining operations the asphaltenes and metals cause interstitial plugging of the catalyst beds and reduced catalyst life and various metal deposits on a catalyst tend to poison or deactivate the catalyst. Moreover, the asphaltenes tend to reduce the susceptibility of hydrocarbon streams to desulfurization.

In the petroleum industry, the asphaltene content of distillation heavy residue, commonly termed resid, has long been a problem for economic conversion of the resid into lower boiling, more valuable products. Hydrocracking has been a well-known method of converting higher boiling feedstocks into lower boiling products but hydrocracking has not generally been commercially successful in converting asphaltene-containing resid feedstock. In general, hydrocracking is the treatment of a feedstock at elevated temperature and pressure in an atmosphere of hydrogen and in the presence of a dual functional catalyst having both hydrogenation and cracking activity. Because of the elevated temperature and pressure employed, hydrocracking requires a substantially higher investment than commonly employed thermal coking which achieves limited resid conversion.

To be a competitive alternative process for treating petroleum resid and other heavy hydrocarbon streams containing asphaltenes, a hydrocracking process must successfully convert a substantial portion of the asphaltenes into lower boiling more valuable products in continuous, reliable operation. Such operation has generally proved unattainable because substantial conversion of the asphaltenes together with the material boiling above 1,000° F. to lower boiling products has required very severe operating conditions, resulting not only in asphaltene plugging of catalyst beds but, in addition, plugging in downstream lines and equipment due to remaining unconverted asphaltenes precipitating out of the hydrocrackate effluent. At about 300° F. hydrotreated asphaltenes remaining in hydrocrackate effluent have less than one-fifth the solubility of virgin asphaltenes in hydrocrackate but above about 400° F., hydrotreated asphaltenes have almost the same solubility as virgin asphaltenes. Even so, when economic operation dictates removal of asphaltenes from the heavy hydrocarbon streams, the processes previously proposed for deasphaltene treatment have not been generally competitive with commercial coking operations.

U.S. Pat. No. 2,715,603 (Lanning et al., 1955) discloses a process for removal of asphaltenes from the recycle stream in hydrogenolysis of heavy oil using suspended catalyst; the process disclosed employs a single-stage, severe hydrotreating reaction under very high pressure with the fractionated heavy stream deasphaltened and recycled to extinction and overall the process would produce only a distillate product.

U.S. Pat. No. 3,132,088 (Beuther et al., 1964) discloses a process for treatment of heavy hydrocarbon stocks which contain asphaltic materials wherein the feedstock is subjected to visbreaking and deasphalting prior to catalytic hydrogenation, thus sacrificing asphaltene hydroconversion. The Beuther patent does not teach or suggest deasphalt treatment of the catalytic hydrogenation effluent.

The general object of this invention is to obtain lower boiling hydrocarbons from heavy hydrocarbon streams containing asphaltenes which are readily converted under mild hydrocracking conditions while employing a second more severe hydrotreatment to convert heavier materials without asphaltenes present, thus avoiding plugging and asphaltene precipitation problems in the hydrotreated effluent. An additional object of this invention is to treat heavy hydrocarbon streams containing asphaltenes in a manner which will remove the most difficultly converted asphaltenes from a mildly hydrotreated stream in which such asphaltenes are readily separated.

We have found that the objectives of this invention can be attained in a process which comprises hydrocracking the heavy hydrocarbon feedstock containing asphaltenes in a first hydrocracking zone followed by removal of the asphaltenes from the liquid effluent of said first hydrocracking step to form a deasphaltened liquid, and hydrocracking said deasphaltened liquid in a second hydrocracking zone.

SUMMARY OF THE INVENTION

Briefly, this invention comprises the steps of first mildly hydrocracking an asphaltene-containing heavy hydrocarbon feedstock, followed by removing the asphaltenes from the liquid effluent from the first hydrocracking step, and then hydrocracking the deasphalted liquid in a second hydrocracking zone. The asphaltenes can be selectively removed from a mildly hydrocracked feedstock without losing the yield from readily converted asphaltenes. The deasphaltened mixture can then be more severely hydrocracked to a high conversion level without the plugging problems caused by asphaltene deposition. As a result, the overall process can attain at least 75 wt.% conversion of the feedstock material boiling over 1,000° F. Removed asphaltene product can be employed, for example, as a component for blending asphalt pavement.

Typical feedstocks that can be treated satisfactorily by the process of the present invention can contain as high as 25 wt.% asphaltenes and include crude oils, topped crude oils, petroleum hydrocarbon residua, both atmospheric and vacuum residua, oils obtained from tar sands and residua derived from tar sand oil, and hydrocarbon streams derived from coal.

Various embodiments of this invention can be employed and the hydrocracking steps can be carried out in any of the alternative conventional reactors; fixed bed, ebullating bed, or moving bed hydrocracking processes can be used in either the first or the second hydrocracking zones. When the operating pressure of the hydrocracking zones are different, the flow of hydrogen-rich gas from the higher pressure to the lower pressure can be facilitated without further compression. In general, the second hydrocracking zone can be operated at higher temperature than the first hydrocracking zone though pressure can generally be lower in the second zone.

In the first hydrocracking step, the raw asphaltene containing feedstock can be contacted at a liquid hourly space velocity (LHSV) of from 0.1 to 10 volumes per hour of feed per volume of catalyst with from 1,000 to 20,000 Standard Cubic Feet per Barrel of raw feed (SCFB) of hydrogen-containing gas, at a temperature in the range 600° to about 820° F., a pressure in the range 400 to 3,000 psig in the presence of a typical large-pore hydrocracking catalyst. Preferably, the contacting conditions in the first hydrocracking step can be a LHSV of 0.2 to 5 volumes of feed per hour per volume of catalyst, 3,000 to 12,000 SCFB of hydrogen-containing gas, 900 to 2,500 psig total pressure, and from 680° to 820° F. The hydrocracking catalyst in general can comprise a hydrogenation component supported on a refractory inorganic oxide matrix. Typical hydrocracking catalyst can comprise at least one hydrogenation metal selected from the Group VIB metals chromium, molybdenum, and tungsten and/or the Group VIII metals iron, cobalt, nickel, ruthenium, rhodium, platinum, palladium, osmium, and iridium, supported on a large-pore refractory inorganic oxide. Preferred catalyst comprises about 1–20 wt.% molybdenum trioxide and can additionally comprise 1–5 wt.% cobalt oxide, supported on a large-pore alumina, with the catalyst having a surface area within the range of about 125 to 400 square meters per gram and an average pore diameter within the range of about 60 to 250 angstroms, more preferably about 100–200 angstroms.

The liquid effluent from the first hydrocracking step can be treated in a deasphaltening process. Such processes include settling or deposition of the asphaltenic material from a cooled liquid or solvent deasphaltening, either of which can include centrifugation. Advantageously, a solvent deasphaltening process can be used whereby an appropriate solvent in weight ratio of about 1–10 parts solvent per part hydrocrackate is employed to dissolve the nonasphaltenic constituent leaving an asphaltenic precipitate which can be filtered from the resulting mixture. Preferably, paraffin solvent such as the various isomers of pentane, hexane, or heptane can be used in the deasphaltening process with removal of the solvent from the deasphaltened filtrate and recycle of the solvent.

The second hydrocracking step, treating the deasphaltened liquid, can be operated in a manner similar to the first hydrocracking step, though generally the conditions will be more severe; a LHSV of 0.1 to 10 volumes per hour of feed per volume of catalyst, 1,000 to 20,000 SCFB of hydrogen-containing gas, a temperature of 600° to 900° F., and a pressure of 400 to 3,000 psig can be employed. Preferably, the conditions in the second hydrocracking zone can be in the following ranges:

LHSV 0.2 to 5 vol/hr/vol
$H_2$ Gas Rate 3,000 to 12,000 SCFB
Pressure 900 to 2,500 psig
Temp. 700 to 850° F.

Typical catalyst, as previously described, is suitable for use in the second hydrocracking step and can be the same as the catalyst used in the first hydrocracking step, although the substantial absence of asphaltenes in the second hydrocracking step can allow greater flexibility in catalyst optimization.

BRIEF DESCRIPTION OF THE DRAWING

The drawing presents a schematic flow diagram of an embodiment of the invention. The process flow configuration hereinafter described should not, however, in any way be construed to limit the scope of the invention as claimed.

The asphaltene-containing heavy feedstock from line 11 is passed through line 13 where it is mixed with make-up hydrogen-rich gas contained in line 14 and recycle hydrogen-rich gas contained in line 15. The total feed mixture is passed to the first hydrocracking reactor 17 through line 14. After contacting in first hydrocracking step, the effluent therefrom passes through line 18 into the gas liquid separator 19 where hydrogen-rich gas is removed and sent through line 20 to the second hydrocracking step 30. A hydrogen-rich recycle stream for the first hydrocracking step may be removed from line 20 by way of line 15. Additional make-up hydrogen can be added to the hydrogen-rich gas in line 20 through line 41. An asphaltene containing liquid is removed from the gas-liquid separator 19 by line 21 and passed to the stripper 40 where the liquid is separated into a fraction boiling below about 1,000° F. and a fraction boiling above about 1,000° F. The fraction boiling below 1,000° F. is passed overhead by way of line 42 into the product fractionator 29. The fraction boiling above 1,000° F. is passed by way of line 43 into the deasphalting step 22 where unconverted asphaltenes are removed from the unconverted fraction. An asphaltene product can be removed by way of line 23. The deasphalted fraction is removed from the deasphalting step 22 through line 24 (and optionally mixed with a heavy recycle liquid in line 25 from the product fractionator 29) to the inlet of the second hydrocracking zone 30. At the inlet of the second hydrocracking step 30 the deasphalted liquid is mixed with the hydrogen-rich gas contained in lines 20 and 16. The effluent from the second hydrocracking step 30 is sent by way of line 26 to a gas liquid separator 27. A hydrogen-rich recycle gas stream 16 is removed from the gas liquid separator 27 and passed to the inlet of the second hydrocracking step 30. The liquid bottoms in the gas liquid separator 27 is passed by way of line 28 into the product fractionator 29. The product fractionator 29 separates the heavy liquid in line 32 from lighter products removed overhead through line 31. Optionally, heavy liquid can be recycled through line 25 and passed to line 24 where it is mixed with the deasphalted fraction from the deasphalting step.

TABLE I

| FEEDSTOCK PROPERTIES | A | B |
|---|---|---|
| Gravity, °API | 5.8 | 8.1 |
| Sulfur, wt. % | 4.02 | 1.33 |
| Nitrogen, wt. % | 0.53 | 0.52 |
| Hydrogen, wt. % | 9.93 | 10.30 |
| Ramsbottom Carbon, wt. % | 21.4 | 18.4 |
| Pour Point, °F. | 125 | 120 |

TABLE I-continued

| FEEDSTOCK PROPERTIES | A | B |
|---|---|---|
| Metals, ppm | | |
| V | 138 | 90 |
| Ni | 45 | 40 |
| Fe | 17 | 20 |
| Fraction Composition, wt. % | | |
| 1000° F.− | 3.9 | 1.3 |
| 1000° F.+ | 96.1 | 98.7 |
| Composition, Wt. % on Feed | | |
| Oils | 18.7 | 22.8 |
| Resins | 62.2 | 59.6 |
| Asphaltenes | 19.1 | 16.6 |

Tests processing petroleum vacuum distillation residue with properties presented in Table I were performed using a pilot plant having a nominal operating capacity of 2 BBL/day. The reactor was 28.25 ft in length and was electrically heated so as to allow adiabatic temperature control. To avoid exothermic temperature runaways, the reactor was segregated into four catalyst zones with quench gas inlets located at the bottom of zones 1, 2, and 3. The four zones were respectively 5.0 ft, 5.0 ft, 7.0 ft and 10.25 ft in length. The feed inlet was located 1.0 ft from the top of the reactor. About 10 in. of the dead space above the feed inlet was filled with inert ¼ in. alumina balls.

An oil quench line was provided at the bottom flange to allow injection of solvents to minimize asphaltene precipitation. Hydrogen rich gas, both fresh and recycle, was preheated in a gas preheater. This preheated gas was then mixed with fresh feed and recycle liquid and passed to a gas-oil preheater. The total mixture was then sent to the reactor.

The product recovery section consisted of an effluent cooler, high pressure separator, recycle lines, low pressure separator, and atmospheric and vacuum distillation towers.

The catalyst used throughout the work described herein consisted of cobalt and molybdenum hydrogenation metals supported on a typical alumina manufactured by the Nalco Chemical Company, commonly referred to as Nalco HF alumina. The catalyst composition contained 3 wt.% cobalt calculated as CoO and 14 wt.% molybdenum calculated as $MoO_3$ and had average pore diameter in the range 65–85 Å.

In an attempt to achieve about 70 wt.% conversion to material boiling below 1,000° F. in a single hydrocracking step, the reactor was operated at about 790°–800° F., liquid hourly space velocity (LHSV) about 0.3, total pressure of about 2,100 psig, and recycle gas rate about 5,600 to 6,700 SCFB. Even when heavy solvents were injected into the reactor effluent, asphaltene precipitation occurred in the downstream piping and ultimately the third catalyst bed became plugged as the conversion approached 69%.

The following examples are illustrative of this invention but do not indicate limitation on the scope of the claims.

EXAMPLE 1

Feedstock A was hydrocracked in the pilot plant reactor which had been loaded with approximately 24 lbs. of the previously described fresh hydrocracking catalyst in the form of 1/16 in. and 1/32 in. extrudate. The reactor was operated at the following conditions:

Temperature, °F. 770 to 780
LHSV, vo/hr/vc 0.5
Total Pressure, psig 2,100
Recycle Gas Rate, SCFB 7,000 to 9,000

At about 150 hours on oil, a sample was taken. The conversion to material boiling below 1,000° F. was determined to be 53.3 wt.%. The fraction boiling below 650° F., which was 19.1 wt.%, was removed from the total liquid product. The remaining material boiling above 650° F. was then deasphaltened by a n-heptane solvent deasphaltening technique. 687.3 grams of liquid boiling above 650° F. was mixed with about 10 times its weight of normal heptane. This mixture was refluxed for two hours at 210° F. The hot mixture was then filtered. 45.4 grams of asphaltene solids were recovered and again remixed with about 10 times its weight of n-heptane. After refluxing at 210° F. for two more hours, the mixture was filtered. The solids weighed 32.8 grams. The filtrate was added to the filtrate from the first wash. The yield of solid asphaltenic materials was 4.8 wt.% based on material boiling above 650° F., or 3.9 wt.% based on total liquid product. The deasphaltened liquid product contained 0.07 wt.% residual asphaltenes. The n-heptane was flash separated from the deasphaltened liquid.

The deasphaltened liquid was then contacted in a bench scale hydrocracking unit at the following conditions:

Temperature, °F. 820
LHSV, vo/hr/vc 0.5
Total pressure, psig 1,650
Once Through $H_2$ Rate, SCFB 23,000

The LHSV is based on the liquid feed to this second hydrocracking reactor. The bench scale reactor was ⅝ in. ID with an axial thermowell transversing the center and was heated by an electrical heating block. The catalyst loaded was an aged sample of the catalyst described previously, that had been removed from the second bed of the pilot reactor after about 1,500 hours on oil. Approximately 30 cc of this catalyst was ground to pass 16–24 mesh before loading. At the above contacting conditions, a conversion of 75.3 wt.% to material boiling below 1,000° F. was obtained. The total liquid product contained only 0.4 wt.% asphaltenes (synthetically generated in hydrocracking) thus indicating that extended operations at these high conversion conditions would not be hampered by reactor plugging or asphaltene precipitation problems.

EXAMPLE 2

Another run was made in which the bench scale reactor was operated as the first hydrocracking zone with the catalyst previously aged 1,500 hours on oil in the pilot reactor. Feedstock B was processed under following conditions:

Temperature, °F. 770 to 780
LHSV, vol/hr/vc 0.5
Total Pressure, psig 1,650
Once Through $H_2$ Rate, SCFB 21,500

Effluent sample indicated that conversion to material boiling below 1,000° F. was approximately 39 wt.%. The entire liquid product sample was deasphaltened with n-heptane by the technique described in Example 1. The yield of solid asphaltenic materials was approximately 12.9 wt.% based on the liquid sample; the deasphaltened liquid product contained approximately 1 wt.% residual asphaltenes.

The deasphaltened liquid product was then processed over the aged catalyst in the bench scale hydrocracking unit at the following conditions:

Temperature, °F. 820
LSHV, vol/hr/vc 0.5
Total Pressure, psig 1,650
Once Through $H_2$ Rate, SCFB 21,500

A conversion of approximately 72 wt.% to material boiling below 1,000° F. was achieved based upon the deasphaltened feed to this second hydrocracking zone. The total liquid product from the second hydrocracking zone contained approximately 1.4 wt.% asphaltenes, indicating once again a very small amount of synthetic heptane-insoluble asphaltenes were generated in the second hydrocracking zone.

The high activity of the fresh catalyst employed in the first hydrocracking zone of Example 1 produced approximately 53 wt.% conversion of the 1,000° F.+ content of the feedstock and approximately 80 wt.% conversion of the asphaltenes, and the lower-activity, aged catalyst employed in the first hydrocracking step of Example 2 produced a 39 wt.% conversion of the 1,000° F.+ content of the feedstock and 22 wt.% asphaltene conversion. Overall conversion after the second hydrocracking step of Example 1 was approximately 86 wt.% of the 1,000° F. content of the original feedstock and the overall conversion after the second hydrocracking zone of Example 2 was approximately 75 wt.% of the 1,000° F. content of the original feedstock. These high conversions were achieved without plugging or asphaltene precipitation problems because asphaltenes were removed before the second hydrocracking steps in each example and in each case the asphaltene content of the heavy liquid product was low enough for an acceptable residual fuel.

We claim:

1. A process for treating a heavy hydrocarbon stream containing asphaltenes which process comprises: hydrocracking said heavy hydrocarbon stream in the presence of hydrogen and a hydrocracking catalyst in a first hydrocracking zone, removing asphaltenes from the liquid effluent of said first hydrocracking zone to form a deasphaltened liquid, and hydrocracking said deasphaltened liquid in the presence of hydrogen and a hydrocracking catalyst in a second hydrocracking zone.

2. The process of claim 1, wherein the heavy hydrocarbon stream containing asphaltenes comprises at least one member selected from the group consisting of crude oil, topped crude oil, petroleum hydrocarbon residua, oils obtained from tar sands, residua derived from tar sands oil, and hydrocarbon streams derived from coal.

3. The process of claim 1, wherein the heavy hydrocarbon stream containing asphaltenes comprises petroleum hydrocarbon residua.

4. The process of claim 1, wherein asphaltenes are removed from the liquid effluent of the first hydrocracking zone by contacting said liquid effluent with a solvent, to form an asphaltenic precipitate from the resulting dissolved hydrocarbon mixture.

5. The process of claim 4, wherein the solvent comprises at least one member selected from the group consisting of pentane, hexane, and heptane.

6. The process of claim 1, wherein conditions in the first hydrocracking zone comprise a liquid hourly space velocity within the range of about 0.1 to about 10 volumes of hydrocarbon per hour per volume of catalyst, a temperature within the range of about 680° F. to about 820° F., and a pressure within the range of about 900 to about 2,500 psig.

7. The process of claim 1, wherein conditions in the second hydrocracking zone comprise a liquid hourly space velocity within the range of about 0.2 to about 5 volumes of hydrocarbon per hour per volume of catalyst, a temperature within the range of about 700° F. to about 850° F., and a pressure within the range of about 900 to about 2,500 psig.

8. The process of claim 1, wherein the effluent from the second hydrocracking zone is fractionated to produce products comprising a bottoms heavy liquid.

* * * * *